US008342715B2

(12) United States Patent
Lee

(10) Patent No.: US 8,342,715 B2
(45) Date of Patent: Jan. 1, 2013

(54) LENS ARRANGEMENT FOR TELESCOPIC ILLUMINATOR

(76) Inventor: Wen-Sung Lee, Taichung (TW)

( * ) Notice: Subject to any disclaimer, the term of this patent is extended or adjusted under 35 U.S.C. 154(b) by 189 days.

(21) Appl. No.: 13/048,887

(22) Filed: Mar. 16, 2011

(65) Prior Publication Data

US 2012/0236564 A1 Sep. 20, 2012

(51) Int. Cl.
*F21V 19/02* (2006.01)

(52) U.S. Cl. ..... 362/285; 362/232; 362/508

(58) Field of Classification Search ..... 362/188, 362/232, 233, 240, 241, 244, 245, 285, 294, 362/326, 327, 335, 350, 373, 507, 508, 514, 362/519, 523, 548
See application file for complete search history.

(56) References Cited

U.S. PATENT DOCUMENTS

| | | | | |
|---|---|---|---|---|
| 2,556,328 | A * | 6/1951 | Hinds | 362/309 |
| 4,307,439 | A * | 12/1981 | Sassmannshausen | 362/186 |
| 2005/0168986 | A1* | 8/2005 | Wegner | 362/241 |
| 2008/0043470 | A1* | 2/2008 | Wimberly | 362/268 |
| 2008/0198615 | A1* | 8/2008 | Klipstein | 362/538 |
| 2011/0075436 | A1* | 3/2011 | Zanma | 362/516 |
| 2011/0170289 | A1* | 7/2011 | Allen et al. | 362/235 |

* cited by examiner

*Primary Examiner* — Hargobind S Sawhney

(57) ABSTRACT

A lens arrangement for telescopic illuminator includes a reflector. The reflector has a cavity defined therein. An inner periphery of the cavity is annularly formed with a conical surface. The conical surface is inwardly inclined. A convex lens is disposed in the cavity and positioned in a middle part of the reflector. A tapered portion is annularly disposed on an outer periphery of the reflector and inclined toward the inner end of the reflector. A flat surface is formed on the inner end of the reflector. The flat surface has a receiving hole centrally defined therein and passing therethrough. A lamp movably is disposed adjacent to the reflector. The lamp is born by an aluminum board.

2 Claims, 4 Drawing Sheets

LENS ARRANGEMENT FOR TELESCOPIC ILLUMINATOR

BACKGROUND OF THE INVENTION

1. Field of the Invention

The present invention relates to a lens arrangement, and more particularly to a lens arrangement for telescopic illuminator.

2. Description of Related Art

A conventional telescopic flashlight includes a first tube and a second tube sleeved on the first tube. The first tube is movable relative to the second tube. The first tube has a lamp mounted therein. The second tube has a convex lens mounted therein for corresponding to the lamp. Therefore, the first tube is moved relative to the second tube to adjust a distance between the lamp and the convex lens for providing a diffusion-lights effect or a focus-lights effect. The main character of the conventional telescopic flashlight is the arrangement of the lamp between the convex lens. The convex lens has a transparent hemisphere reflector connected thereto. When the lamp is moved away from the convex lens, light beams emitted from the lamp are refracted into the reflector and reflected from an edge of the reflector for focusing the light beams. When the lamp is moved toward the reflector, the light beams emitted from the lamp are refracted and reflected from the reflector for diffusing the light beams. The conventional telescopic flashlight generates a lot of heat, such that an aluminum board is generally required and connected with the lamp for dissipating the heat. However, the space in the reflector is restricted, such that the lamp is not able to be fully received in the reflector and the aluminum board is abutted against the reflector. If the size of the aluminum board is reduced to be received in the space in the reflector, the heat-dissipating effect of the aluminum board is diminished.

The present invention has arisen to mitigate and/or obviate the disadvantages of the conventional telescopic flashlight.

SUMMARY OF THE INVENTION

The main objective of the present invention is to provide a lens arrangement, and more particular to a lens arrangement for telescopic illuminator.

To achieve the objective, the lens arrangement for telescopic illuminator in accordance with the present invention includes a reflector. The reflector has a cavity defined therein and inwardly extending thereto. An inner periphery of the cavity is annularly formed with a conical surface. The conical surface is inwardly inclined such that an inner diameter of an inner end of the reflector is less than that of an outer end of the reflector. A convex lens is disposed in the cavity and positioned in a middle part of the reflector. A tapered portion is annularly disposed on an outer periphery of the reflector and inclined toward the inner end of the reflector such that an outer diameter of the inner end of the reflector is less than that of the outer end of the reflector. A flat surface is formed on the inner end of the reflector. The flat surface has a receiving hole centrally defined therein and passing therethrough. A lamp is movably disposed adjacent to the reflector for providing to emit light beams into the reflector, the lamp borne by an aluminum board for dissipating the head generated from the lamp. The receiving hole has a depth being equal or greater than a thickness of the lamp and the receiving hole has a maximum inner diameter being grater than a width of the aluminum board. The receiving hole has a tapered inner periphery such that the diameter of the receiving hole is reduced from the inner end of the reflector toward the outer end of the reflector.

The conventional telescopic illuminator has a hemisphere structure disposed on an inner end thereof. However, the present invention provides the flat surface, such that the lamp and the aluminum board are able to more closely move toward the reflector. The lamp is able to be partially received in the receiving hole and the aluminum board is able to move closer to the receiving hole. The space between the aluminum board and the reflector is increased, such that the size of the aluminum board is also deservedly increased. The bigger-sized aluminum board effectively dissipates the head of the lamp to prevent the telescopic illuminator of the present invention from overheating.

Further benefits and advantages of the present invention will become apparent after a careful reading of the detailed description with appropriate reference to the accompanying drawings.

DETAILED DESCRIPTION OF THE INVENTION

Figure 1:
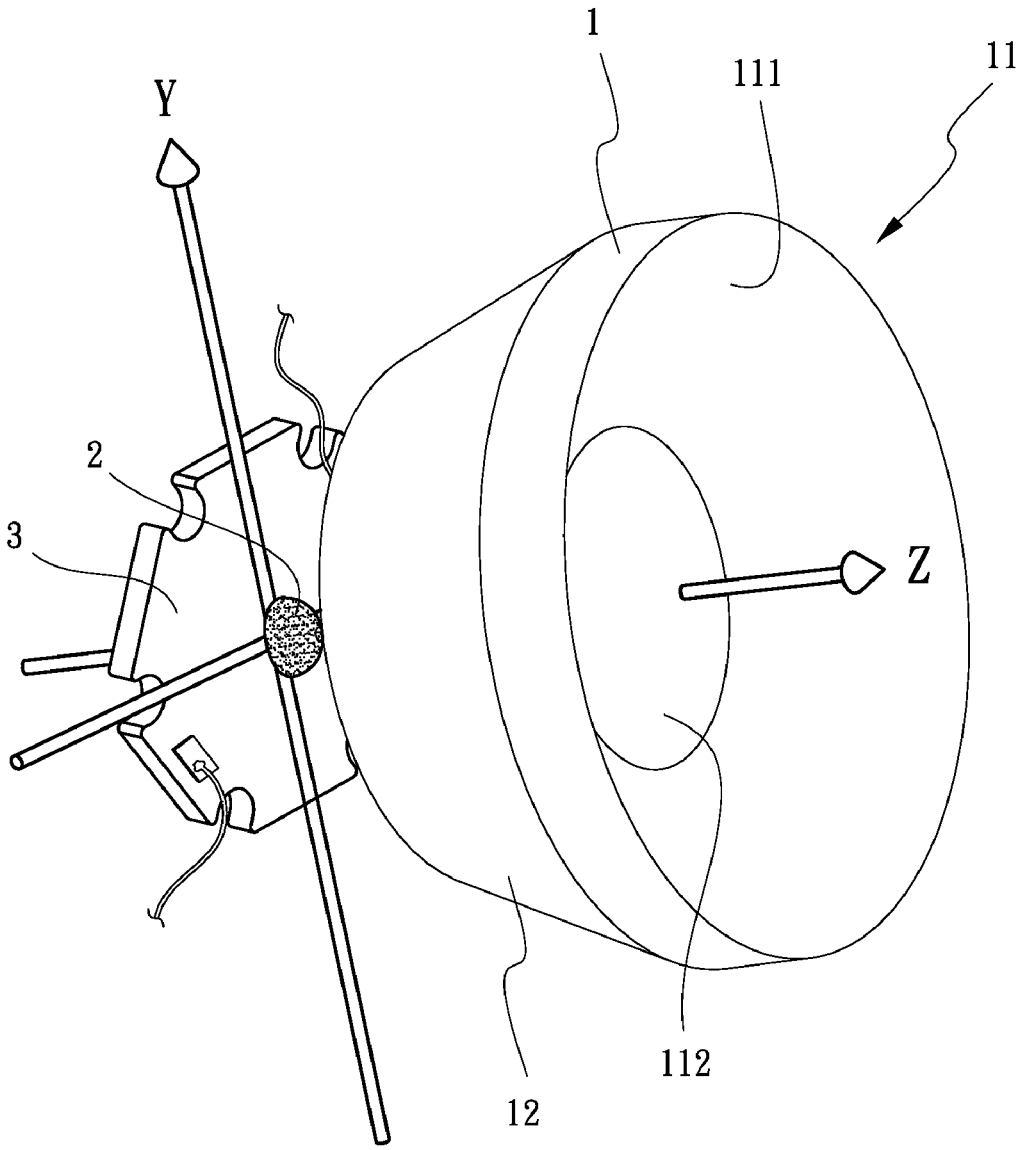
FIG. 1 is a perspective view of a lens arrangement for telescopic illuminator in accordance with the present invention.
Figure 2:
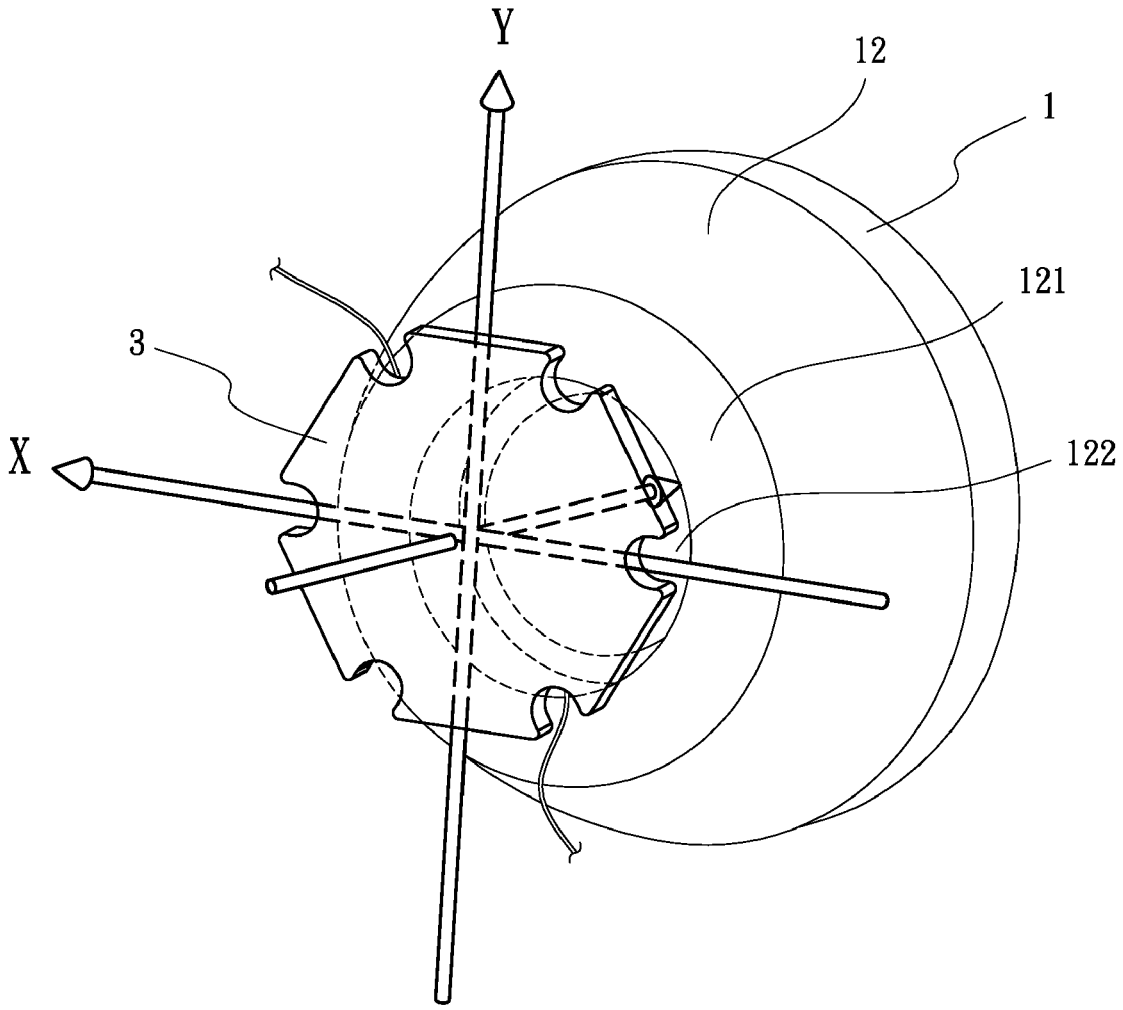
FIG. 2 is a perspective view of the lens arrangement for telescopic illuminator in accordance with the present invention in another direction.

Referring to the drawings and initially to FIGS. 1-2, a lens arrangement for telescopic illuminator in accordance with the present invention comprises a reflector 1. The reflector 1 has an inner end formed thereon for assembling with a power source and an outer end formed thereon for projecting light beams. The outer end of the reflector 1 has a cavity 11 defined therein and inwardly extending thereto. As shown in FIGS. 1-2, the reflector 1 has a bowl-shaped structure. An inner periphery of the cavity 11 is annularly formed with a conical surface 111. The conical surface 111 is inwardly inclined such that an inner diameter of the inner end of the reflector 1 is less than that of the outer end of the reflector 1. A convex lens 112 is disposed in the cavity 11 and positioned in a middle part of the reflector 1 such that the front end of the reflector 1 is provided for projecting light beams. The light beams are refracted by the convex lens 112 and reflected by the conical surface 111 to be projected from the cavity 11.

A tapered portion 12 is disposed on the inner end of the reflector 1. The tapered portion 12 is annularly on an outer periphery of the reflector 1 and inclined toward the inner end of the reflector 1 such that an outer diameter of the inner end of the reflector 1 is less than that of the outer end of the reflector 1. The inclined arrangement of the tapered portion 12 is responded to a direction of the light beams for collecting the light beams toward the convex lens 112 and the conical surface 111.

A flat surface 12 is formed on the inner end of the reflector 1. The flat surface 12 has a receiving hole 122 centrally defined therein and passing therethrough. A lamp 2 is movably disposed adjacent to the reflector 1 for providing to emit light beams into the reflector 1. The lamp 2 is borne by an aluminum board 3 for dissipating the heat generated from the lamp 2. The receiving hole 122 has a depth (D) being equal or greater than a thickness (d) of the lamp 2 ($d \geqq D$). The receiving hole 122 has a maximum inner diameter (1) is grater than a width (L) of the aluminum board 3 ($L>1$). The receiving hole 122 has a tapered inner periphery such that the diameter of the receiving hole 122 is reduced from the inner end of the reflector 1 toward the outer end of the reflector 1. The lamp 2 is able to be fully received in receiving hole 122 and the aluminum board 3 is able to approach to the receiving hole 122.

Figure 3:
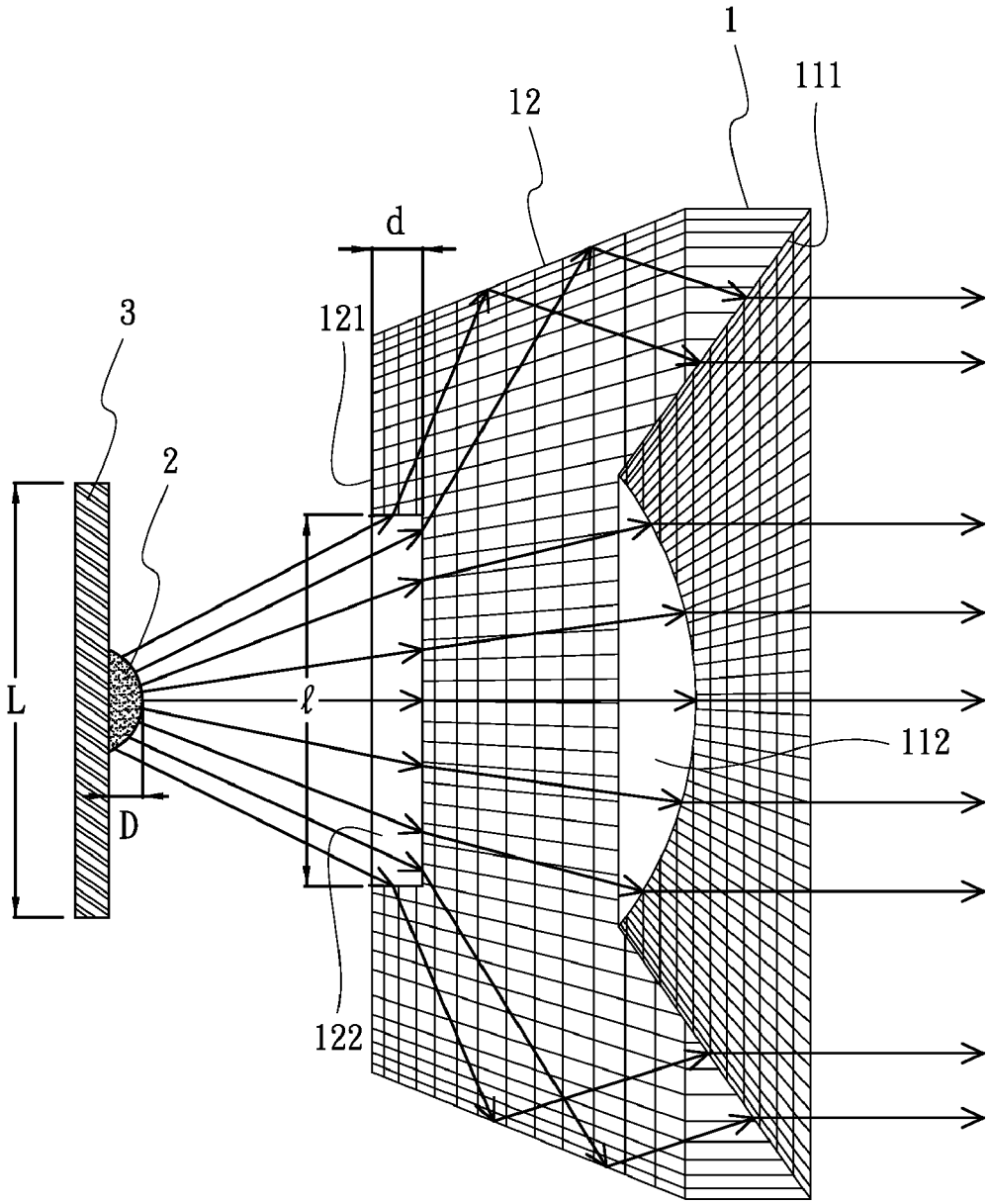
FIGS. 3-4 are operation views of the lens arrangement for telescopic illuminator in accordance with the present invention.

Referring to FIG. 3, when the lamp 2 and aluminum board 3 are moved away from the reflector 1, the light beams emitted from the lamp 2 are pass through the receiving hole 122 and reflected from the inner periphery of the tapered portion 12 toward the conical surface 111 and the convex lens 112, such that the light beams reflected and refracted from the cavity 11 are condensed.

When the light beams penetrate from a medium having a higher refractive index ($n_1$) into a medium having a lower refractive index ($n_2$), for instance, from water into air, if an incident angle $\theta_1$ equals to an angle $\theta c$, a path of the refracted light beams is disposed along a tangent line of the interface between the two mediums, such that the refracted angle $\theta_2$ equals to 90 degrees, therefore $\sin \theta_2=1$, and $\sin \theta c=\sin \theta_1=n_2/n_1$. If the incident angle $\theta_1$ is greater than the angle $\theta c$, $\sin \theta_1>n_2/n_1$ and $\sin \theta_2>1$, such that there is no refracted light beams existing and a reflecting light beams for generating a total internal reflection. The minimum incident $\theta c$ for generating the total internal reflection is called critical angle. The value of the critical angle is depended on ratio of the two refractive indexes of the two medium, such that $\theta c=\sin^{-1}(n_2/n_1)$, the present invention is based on above method. The light beams emitted by the lamp 2 is projected to the inner periphery of the tapered portion 12 from the inner end of the reflector 1 for utilizing the above method based on the total internal reflection.

Figure 4:
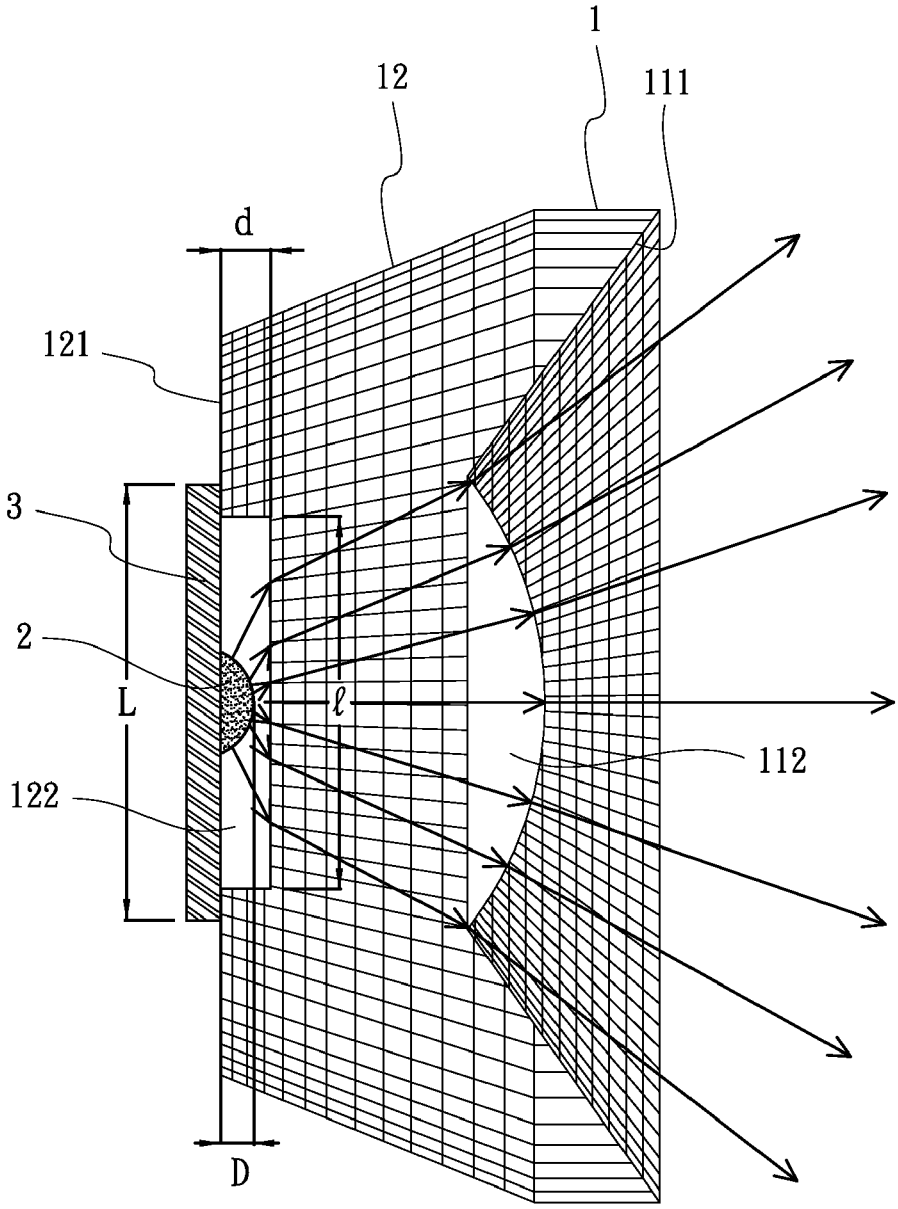

Referring to FIG. 4, the lamp 2 and the aluminum board 3 are moved toward the reflector 1, the lamp 2 is gradually received in the receiving hole 122 and the aluminum board 3 is located adjacent the receiving hole 122. The light beams emitted by the lamp 2 pass through the convex lens 112 such that the light beams are diffusely refracted and projected toward the outer end of the reflector 1. The flat surface 121 and the receiving hole 122 allow the lamp 2 with the aluminum board 3 closely moving toward the reflector 1. Therefore, the lamp 2 is moved closer to the convex lens 112, the diffusing effect will be more obvious. The space between the aluminum board 3 and the reflector 1 is increased, such that the size of the aluminum board 3 is also deservedly increased. Comparing with the aluminum board of the prior art, the bigger sized aluminum board 3 effectively dissipates the head of the lamp 2 to prevent the telescopic illuminator of the present invention from overheating, such that operating lift of the telescopic illuminator of the present invention is increased.

Although the invention has been explained in relation to its preferred embodiment, it is to be understood that many other possible modifications and variations can be made without departing from the spirit and scope of the invention as hereinafter claimed.

What is claimed is:

1. A lens arrangement for telescopic illuminator, comprising:

a reflector, the reflector having a cavity defined therein and inwardly extending thereto, an inner periphery of the cavity annularly formed with a conical surface, the conical surface inwardly inclined such that an inner diameter of an inner end of the reflector is less than that of an outer end of the reflector;

a convex lens disposed in the cavity and positioned in a middle part of the reflector;

a tapered portion annularly disposed on an outer periphery of the reflector and inclined toward the inner end of the reflector such that an outer diameter of the inner end of the reflector is less than that of the outer end of the reflector;

a flat surface formed on the inner end of the reflector, the flat surface having a receiving hole centrally defined therein and passing therethrough;

a lamp movably disposed adjacent to the reflector for providing to emit light beams into the reflector, the lamp borne by an aluminum board for dissipating the head generated from the lamp;

wherein the receiving hole has a depth being equal or greater than a thickness of the lamp and the receiving hole has a maximum inner diameter being grater than a width of the aluminum board.

2. The lens arrangement for telescopic illuminator as claimed in claim 1, wherein the receiving hole has a tapered inner periphery such that the diameter of the receiving hole is reduced from the inner end of the reflector toward the outer end of the reflector.

* * * * *